US009459017B2

(12) United States Patent
Liu

(10) Patent No.: US 9,459,017 B2
(45) Date of Patent: Oct. 4, 2016

(54) AIR TEMPERATURE ADJUSTING SYSTEM

(75) Inventor: Wuqiang Liu, Shenzhen (CN)

(73) Assignees: Chao Liu, Shenzhen, Guangdong (CN); GOOD COMPLIMENT LIMITED, Hong Kong (CN)

( * ) Notice: Subject to any disclaimer, the term of this patent is extended or adjusted under 35 U.S.C. 154(b) by 731 days.

(21) Appl. No.: 13/878,472

(22) PCT Filed: Aug. 16, 2011

(86) PCT No.: PCT/CN2011/078497
§ 371 (c)(1),
(2), (4) Date: Apr. 9, 2013

(87) PCT Pub. No.: WO2012/045254
PCT Pub. Date: Apr. 12, 2012

(65) Prior Publication Data

US 2013/0192289 A1 Aug. 1, 2013

(30) Foreign Application Priority Data

Oct. 9, 2010 (CN) ..... 2010 1 0503235

(51) Int. Cl.
*F24F 1/32* (2011.01)
*F24F 5/00* (2006.01)
*F21V 33/00* (2006.01)

(52) U.S. Cl.
CPC ..... *F24F 5/0003* (2013.01); *F21V 33/0092* (2013.01); *F24F 5/00* (2013.01); *F24F 5/0035* (2013.01); *F24F 5/0042* (2013.01)

(58) Field of Classification Search
CPC ..... F24F 5/003; F24F 5/0065; F24F 6/02; F24F 6/04; F24F 6/043; F24F 6/12; F24F 6/18; F25B 43/00; F25B 43/006; F28D 15/0233; F28D 15/0266; F28D 5/00; F28D 5/02
USPC ..... 261/152, 153, 36.1; 62/100, 171, 304, 62/310, 314
See application file for complete search history.

(56) References Cited

U.S. PATENT DOCUMENTS 2,750,754 A * 6/1956 Emil ..... F25D 3/02 137/91
4,098,854 A * 7/1978 Knirsch ..... F28C 1/14 165/900
CN 101949566 1/2011
JP 2000110270 4/2000
WO 2008062845 5/2008

FOREIGN PATENT DOCUMENTS

CN 1081757 A 2/1994
CN 2545519 Y 4/2003

(Continued)

*Primary Examiner* — Ryan J Walters
*Assistant Examiner* — Antonio R Febles

(57) ABSTRACT

An air temperature adjusting system includes a gas-liquid mixing device, a temperature adjusting device, a gas-liquid separating device and a gas-liquid circulating device for driving gas-liquid to move among the gas-liquid mixing device, the temperature adjusting device and the gas-liquid separating device. The gas-liquid mixing device is for absorbing air into liquid to mix the air with the liquid and bringing a mixture of the air and the liquid into the gas-liquid separating device after a temperature of the mixture is adjusted by the temperature adjusting device; and the gas-liquid separating device is for separating the air with the liquid. The gas-liquid mixing device includes at least one T-shaped pipe, wherein a main pipe of each T-shaped pipe is interconnected; a branch pipe of each T-shaped pipe has an opening intercommunicated to the air.

20 Claims, 1 Drawing Sheet

(56) References Cited

U.S. PATENT DOCUMENTS 4,415,508 A * 11/1983 Aida ..... C07D 301/10
261/114.1
5,084,217 A * 1/1992 Dodds ..... F28D 5/02
137/244
6,205,799 B1 * 3/2001 Patel ..... F25B 39/04
165/104.33
6,990,816 B1 * 1/2006 Zuo ..... B64G 1/50
62/3.7
7,377,492 B2 * 5/2008 Vrana ..... B01D 19/0042
261/29

* cited by examiner

AIR TEMPERATURE ADJUSTING SYSTEM

CROSS REFERENCE OF RELATED APPLICATION

This is a U.S. National Stage under 35 U.S.C 371 of the International Application PCT/CN2011/078497, filed Aug. 16, 2011, which claims priority under 35 U.S.C. 119(a-d) to CN 201010503235.4, filed Oct. 9, 2010.

BACKGROUND OF THE PRESENT INVENTION

1. Field of Invention

The present invention relates to an air temperature adjusting system in a technical field of thermal energy and aerodynamics, and more particularly to a system capable of absorbing air into liquid and then changing a temperature of the air by adjusting the temperature of the liquid.

2. Description of Related Arts

25° C. is the temperature most suitable for human survival. However, the temperature in summer is usually higher than 25° C., which makes it difficult for the human body to rapidly dissipate heat, and thus the man may feel hot; while the temperature in winter is usually lower than 25° C., which makes the human body dissipate heat overly fast, and thus the man may feel cold. In order to create a comfortable environment for living, it is necessary to adjust the temperature to maintain the air temperature around 25° C.

Conventionally, the most common air temperature regulator is the air conditioner. The air conditioner works under the following principle. The gaseous refrigerant is compressed by the compressor into the liquid refrigerant of high temperature and high pressure; and then the liquid refrigerant of high temperature and high pressure is sent into the condenser, i.e., the outdoor unit, for heat dissipation and becomes the liquid refrigerant of normal temperature and high pressure. As a result, the outdoor unit blows hot winds. Then the liquid refrigerant of normal temperature and high pressure enters the evaporator, i.e., the indoor unit, through the capillary; and because the space suddenly enlarges and the pressure suddenly reduces after the refrigerant arrives at the evaporator through the capillary, the liquid refrigerant evaporates to become the gaseous refrigerant of low temperature, so as to absorb a large amount of heat to cool the evaporator. Since the fan of the indoor unit blows indoor air through the evaporator, the indoor unit blows cold winds; the steam in the air meets the cold evaporator and then condenses into water drops which flow out along the water pipe; and then the gaseous refrigerant returns to the compressor to continue being compressed as a circulation.

It is required to shut the doors and the windows indoors when the air conditioner is used to adjust the air. Because the air circulates in a closed environment all the time, the indoor environment can become very dry after a long time and have a poor air quality because of no air exchange for a long time, mainly showed as an increased concentration of carbon dioxide, an increased content of oxidation products of sulfides and nitrides in the air and bacteria, and a reduced content of oxygen. This is why users may feel uncomfortable when the users stay in a room with a working air conditioner for a long time. It is essential to mention that usually the air conditioner has a high power and consumes much electricity, which is unfavorable for environmental protection.

In recent years, an environment-friendly air adjusting device, known as the air conditioner fan, appears. The air conditioner fan works under the following principle. The water circulating pump continually draws water out of the water tank and evenly sprays the water onto the evaporating and filtering layer through the water distributing system; then the outdoor hot air enters the evaporating and cooling medium to fully exchange heat with the water inside the evaporating and cooling medium, i.e., Cell DEK; then the water evaporates and absorbs heat to decrease the temperature and also the cold water turns the hot air into the cool and clean air which is blown out by the low-noise draught fan with added pressure, so the users can feel cool winds. As a result, the air conditioner fan has better cooling effects than the pure electric fan.

Since the air conditioner fan is still a type of fan in essence, the air conditioner fan actually fails to transfer the heat in the air from the indoor to the outdoor. Thus, in order to bring the users a feeling of cool, it is required to produce winds at a really fast speed. Just because of the large wind influx and wind outflux and the fast wind speed, the air conditioner fan causes much noise during work. In the meantime, because of the fast speed of the wind influx and wind outflux, it is really difficult for the air conditioner fan to filter the steam inside the air through drying, so as to cause high humidity of the blown-out air, which further contributes to the growth of the indoor bacteria and causes discomfort of the users.

Furthermore, the pumping motor and the blowing motor of the air conditioner fan work simultaneously, which wastes electricity and brings extra noise.

SUMMARY OF THE PRESENT INVENTION

In order to solve the above technical problems, the present invention provides an air temperature adjusting system having low noise, low energy-consumption and functions of filtering air and purifying air.

According to the present invention, gas-liquid comprises air and liquid.

The present invention adopts following technical solutions.

An air temperature adjusting system comprises a gas-liquid mixing device, a temperature adjusting device, a gas-liquid separating device and a gas-liquid circulating device for driving the gas-liquid to move among the gas-liquid mixing device, the temperature adjusting device and the gas-liquid separating device. The gas-liquid mixing device is for absorbing air into liquid to mix the air with the liquid and bringing a mixture of the air and the liquid into the gas-liquid separating device after a temperature of the mixture is adjusted by the temperature adjusting device; and the gas-liquid separating device is for separating the air with the liquid, wherein the separated air runs out via the gas-liquid separating device. The gas-liquid mixing device comprises at least one T-shaped pipe, wherein a main pipe of each T-shaped pipe is interconnected; a branch pipe of each T-shaped pipe has an opening intercommunicated to the air; and a water level of each T-shaped pipe is higher than a water level of the gas-liquid separating device.

The gas-liquid separating device comprises a liquid storing box having a hole, wherein the hole is intercommunicated to the air and higher than a water level of the liquid storing box.

According to a preferred embodiment of the present invention, the liquid is embodied as water; and then the liquid circulating device comprises a submersible pump and a plurality of pipes respectively connected to respective two ends of the submersible pump, the gas-liquid mixing device, the temperature adjusting device and the gas-liquid separating device, wherein the temperature adjusting device is connected between the gas-liquid mixing device and the gas-liquid separating device via the pipes, and the submersible pump is provided between two members selected from a group consisting of the gas-liquid mixing device, the temperature adjusting device and the gas-liquid separating device.

A water level of a liquid inlet of the gas-liquid mixing device is higher than a water level of a liquid outlet of the gas-liquid mixing device.

The submersible pump is provided inside the liquid storing box of the gas-liquid separating device.

The submersible pump works in an intermittently pumping manner.

According to a preferred embodiment of the present invention, alternatively, the liquid is embodied as magnetic fluid; and then the liquid circulating device comprises an electromagnetic pump and a plurality of pipes respectively connected to respective two ends of the gas-liquid mixing device, the temperature adjusting device or the gas-liquid separating device, wherein the temperature adjusting device is connected between the gas-liquid mixing device and the gas-liquid separating device via the pipes, and the electromagnetic pump is sleeved onto the pipes.

The temperature adjusting device comprises an electronic cooling device and/or an electronic heating device.

The air temperature adjusting system further comprises an ultraviolet disinfecting device. The ultraviolet disinfecting device is provided inside the liquid.

The air temperature adjusting system further comprises a filtering device for filtering off the liquid. The filtering device is provided at a gas outlet of the gas-liquid separating device.

The present invention has following advantageous technical effects.

By providing the plurality of the T-shaped pipes and via the intermittently pumping manner, the liquid of the air temperature adjusting system of the present invention absorbs the air into the water like a piston, which not only efficiently makes use of power of circulating the water but also produces very low noise during a process of absorbing the water, so as to avoid noise of motors.

By mixing the liquid with the air, adjusting the temperature of the mixture and then separating the gas-liquid mixture after adjusting the temperature, the air temperature adjusting system of the present invention obtains the air having the temperature changed at a quick speed because the liquid has a heat exchange rate larger than the air, so as to effectively save energy.

By mixing the liquid with the air and providing the ultraviolet disinfecting device in the liquid, the air temperature adjusting system is capable of not only adjusting the temperature of the air but also disinfecting the air, so as to effectively avoid a problem that the air quality may worsen within a closed environment.

By providing the electronic cooling device, the air temperature adjusting system of the present invention avoids using environment-harmful air refrigerant, such as Freon, and becomes better environment-friendly.

These and other objectives, features, and advantages of the present invention will become apparent from the following detailed description, the accompanying drawings, and the appended claims.

DETAILED DESCRIPTION OF THE PREFERRED EMBODIMENT

The present invention provides an air temperature adjusting system having low noise, low energy-consumption and functions of air filtering and air purifying.

Combined with the preferred embodiments and the drawings, the present invention is further illustrated as follows.

First Preferred Embodiment

Figure 1:
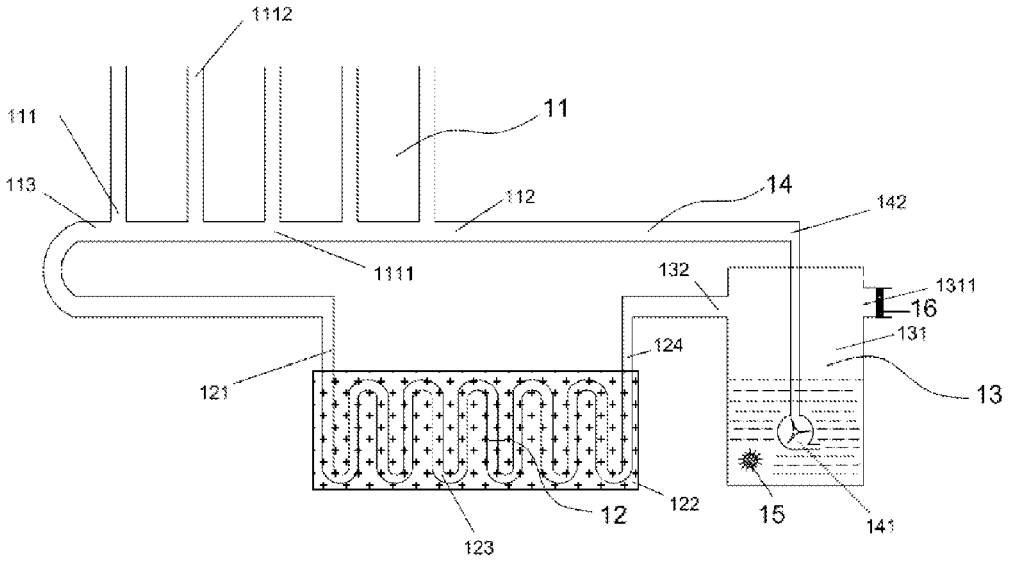
FIG. 1 is a structural sketch view of an air temperature adjusting system according to a first preferred embodiment of the present invention.

Referring to FIG. 1 of the drawings, according to a first preferred embodiment of the present invention, an air temperature adjusting system comprises a gas-liquid mixing device 11, a temperature adjusting device 12, a gas-liquid separating device 13 and a gas-liquid circulating device 14 for driving gas-liquid to move among the gas-liquid mixing device 11, the temperature adjusting device 12 and the gas-liquid separating device 13. The gas-liquid mixing device 11 comprises a plurality of T-shaped pipes 111. A main pipe 1111 of each T-shaped pipe is interconnected. A branch pipe 1112 of each T-shaped pipe has an opening intercommunicated to air. The branch pipe 1112 of each T-shaped pipe is vertical to a ground. A water level of the opening of the branch pipe of the T-shaped pipe is higher than a highest water level of the main pipe 1111 of the T-shaped pipe, in such a manner that the liquid inside the T-shaped pipe is prevented from overflowing the branch pipe. A water level of a water inlet 112 of the gas-liquid mixing device is higher than a water level of a water outlet 113 of the gas-liquid mixing device.

The gas-liquid circulating device 14 comprises a water pump 141 and a plurality of water pipes 142 respectively connected to respective two ends of the water pump 141, the gas-liquid mixing device 11, the temperature adjusting device 12 or the gas-liquid separating device 13.

The water inlet 112 of the gas-liquid mixing device is connected to an outlet of the water pump 141 via the water pipes 142. A liquid storing box 131 of the gas-liquid separating device 13 is provided with the water pump 141 therein. The liquid storing box 131 has a hole 1311 which is also a gas outlet intercommunicated with the air. The water storing box 131 contains water therein. The water pump 141 is a submersible pump provided under a water level of the liquid storing box 131. A highest water level inside the liquid storing box 131 is lower than the hole 1311, in such a manner that the water inside the liquid storing box 131 is prevented from overflowing the hole 1311. The water inside the liquid storing box is pumped by the water pump into the gas-liquid mixing device, passing through the water inlet 112 of the gas-liquid mixing device to enter the main pipes 1111 of the plurality of T-shaped pipes in sequence.

An inlet 121 of the temperature adjusting device 12 is connected to the water outlet 113 of the gas-liquid mixing device via the water pipes 142. The temperature adjusting device 12 comprises a semi-conductor cooling device 122 and a temperature adjusting room 123. The temperature adjusting room 123 has water therein. A cold end of the semi-conductor cooling device 122 is in contact with the temperature adjusting room 123. A hot end of the semi-conductor cooling device 122 is connected with a fan, unshown in the FIG. 1, and an air pipe connected to the fan, unshown in the FIG. 1. Heat of the semi-conductor cooling device is transferred to the outdoor along the air pipe via the fan.

An outlet 124 of the temperature adjusting device 12 and an inlet 132 of the gas-liquid separating device 13 are connected via the water pipes 142; and specifically, an outlet of the temperature adjusting room 123 and an inlet of the liquid storing box 131 of the gas-liquid separating device are connected via the water pipes 142.

The water pump 141 works in an intermittently pumping manner. A water level of an outlet of the T-shaped pipe 111 is higher than a water level of an inlet of the temperature adjusting room 123. A water level of the outlet of the temperature adjusting room 123 is higher than a water level of the inlet of the liquid storing box 131, in such a manner that the water inside the T-shaped pipes 111 is able to flow away when the water pump 141 stops pumping and thus the air inside the branch pipes of the T-shaped pipes is able to enter the main pipes. When the main pipes of the T-shaped pipes have the air entered, the water pump starts to pump again. The water is pumped into the main pipes of the T-shaped pipes, so the water entraining the air enters the water pipes to further flow into the temperature adjusting device 12.

The water inside the liquid storing box 131 is pumped by the water pump 141 into the T-shaped pipes having no water or little water. The water column pumped therein, like a piston, presses the air inside the T-shaped pipe into the outlet at a terminal end of the T-shaped pipe. As a result, a mixture of the water and the air is pressed into the temperature adjusting room of the temperature adjusting device; the air and the water of the mixture turn cold together via heat exchange and thereafter enter the liquid storing box of the gas-liquid separating device. The liquid storing box has the hole, so internal pressure of the liquid storing box equals external pressure thereof, which allows the air to be separated from the water and run out of the liquid storing box via the hole. If the water pump pumps water continuously, the air inside the branch pipes of the T-shaped pipes can be prevented from entering the main pipes, which avoids entraining the air into the temperature adjusting room of the temperature adjusting device; and thus it is required to modify a program of a controlling circuit board connected to the water pump. The water pump is controlled by the controlling circuit board to pump water intermittently.

The air temperature adjusting system further comprises an ultraviolet disinfecting device 15. The ultraviolet disinfecting device 15 is provided inside the water; and specifically, the ultraviolet disinfecting device 15 is provided inside the liquid storing box 131 for exterminating bacteria in the air.

The gas outlet of the liquid storing box 131 is further provided with a filtering device 16. The filtering device 16 is capable of filtering off the liquid inside the air at the gas outlet, so as to prevent the air produced by the air temperature adjusting system from containing too much liquid and thus avoid affecting air quality.

Meanwhile, in order to avoid draining the temperature adjusting room of the temperature adjusting device because the water pump stops pumping, it is necessary to provide the temperature adjusting room with U-shaped pipes. In order to increase a heat exchange rate, the pipes of the temperature adjusting room are U-shaped, as showed in FIG. 1.

The branch pipe of each T-shaped pipe is unsealed. When the water pump draws the water inside the liquid storing box into the T-shaped pipes, it is possible that a part of the water flowing in rapidly enters the branch pipe. In order to prevent the water inside the branch pipe of each T-shaped pipe from overflowing, it is necessary for the branch pipe of each T-shaped pipe to be long enough to avoid overflowing.

Second Preferred Embodiment

Figure 2:
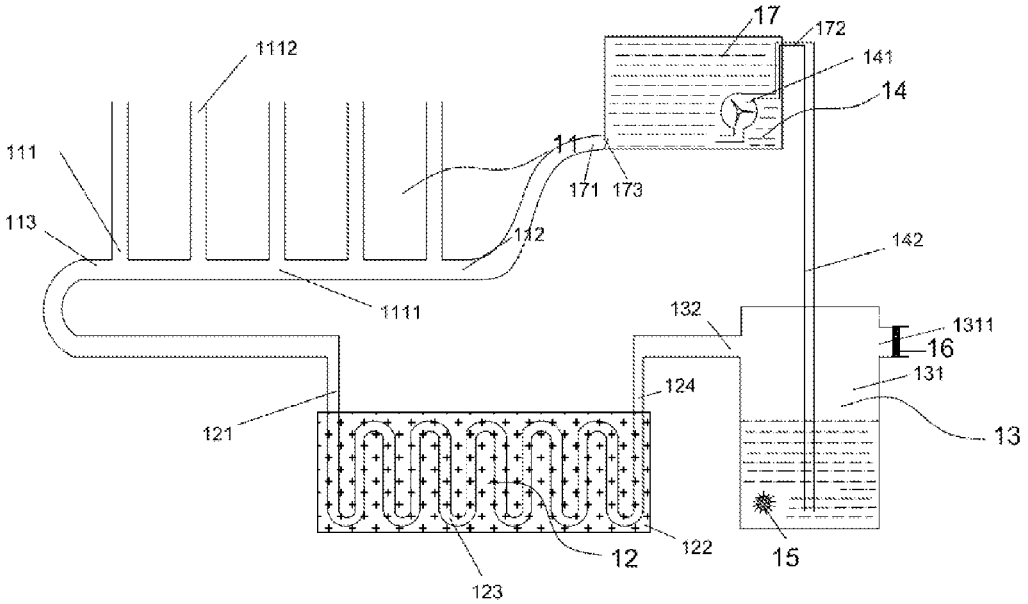
FIG. 2 is a structural sketch view of the air temperature adjusting system according to a second preferred embodiment of the present invention.

As showed in FIG. 2, based on the first preferred embodiment, the air temperature adjusting system according to a second preferred embodiment of the present invention further comprises a closed water tank 17 which is connected to the gas-liquid mixing device 11 via the water pipes. The water tank 17 has a higher water level than the gas-liquid mixing device 11. A water outlet 171 of the water tank 17 is connected to the water inlet of the gas-liquid mixing device 11 via S-shaped pipes, in such a manner that the water inside the water tank 17 smoothly flows into the main pipes of the T-shaped pipes via force of gravity, which not only prevents the water from flowing over quickly to run out of the branch pipes of the T-shaped pipes but also entrains relatively more air via the smoothly flowing to improve efficiency.

The water outlet 171 of the water tank 17 is provided in a lower part of the water tank 17. A water inlet 172 of the water tank 17 is provided in an upper part of the water tank 17. An intermittent switch 173 for controlling the water to intermittently flow into the gas-liquid mixing device 11 is provided at the water outlet 171, wherein the water pump is allowed to pump water continuously, which avoids a problem that the intermittently pumping shortens a service life of the water pump.

One skilled in the art will understand that the embodiment of the present invention as shown in the drawings and described above is exemplary only and not intended to be limiting. According to the principles and thoughts of the present invention, combined with the preferred embodiments, it is easy for the one skilled in the art to make other improvements and modifications about the technical solutions of the present invention. For example, the liquid also can be magnetic fluid and then the liquid circulating device comprises an electromagnetic pump and a plurality of pipes respectively connected to respective two ends of the gas-liquid mixing device, the temperature adjusting device or the gas-liquid separating device; the temperature adjusting device is connected between the gas-liquid mixing device and the gas-liquid separating device via the pipes; and the electromagnetic pump is sleeved onto the pipes. Therefore, this invention includes all modifications encompassed within the spirit and scope of the following claims.

What is claimed is:

1. An air temperature adjusting system, comprising a gas-liquid mixing device, a temperature adjusting device, a gas-liquid separating device and a gas-liquid circulating device for driving gas-liquid to move among said gas-liquid mixing device, said temperature adjusting device and said gas-liquid separating device, wherein said gas-liquid mixing device is for absorbing air into liquid to mix said air with said liquid and bringing a mixture of said air and said liquid into said gas-liquid separating device after a temperature of said mixture of said air and said liquid is adjusted by said temperature adjusting device; said gas-liquid separating device is for separating said air with said liquid, wherein said separated air runs out via said gas-liquid separating device; and said gas-liquid mixing device comprises at least one T-shaped pipe, wherein a main pipe of each T-shaped pipe is interconnected; a branch pipe of each T-shaped pipe has an opening intercommunicated with said air; and each T-shaped pipe has a liquid level higher than a liquid level of said gas-liquid separating device.

2. The air temperature adjusting system, as recited in claim 1, wherein said gas-liquid separating device comprises a liquid storing box having a hole, wherein said hole is intercommunicated with said air and higher than said liquid level of said liquid storing box.

3. The air temperature adjusting system, as recited in claim 2, wherein said liquid is water; said gas-liquid circulating device comprises a submersible pump and a plurality of water pipes respectively connected to respective two ends of said submersible pump, said gas-liquid mixing device, said temperature adjusting device and said gas-liquid separating device; said temperature adjusting device is connected between said gas-liquid mixing device and said gas-liquid separating device via said water pipes; and said submersible pump is provided between two members selected from a group consisting of said gas-liquid mixing device, said temperature adjusting device and said gas-liquid separating device.

4. The air temperature adjusting system, as recited in claim 3, wherein a water inlet of said gas-liquid mixing device has a higher water level than a water outlet of said gas-liquid mixing device.

5. The air temperature adjusting system, as recited in claim 4, wherein said submersible pump is provided inside said liquid storing box of said gas-liquid separating device.

6. The air temperature adjusting system, as recited in claim 3, wherein said submersible pump works in an intermittently pumping manner.

7. The air temperature adjusting system, as recited in claim 6, wherein said temperature adjusting device comprises an electronic cooling device and/or an electronic heating device.

8. The air temperature adjusting system, as recited in claim 3, further comprising an ultraviolet disinfecting device which is provided in said liquid.

9. The air temperature adjusting system, as recited in claim 3, further comprising a filtering device for filtering off said liquid which is provided at a gas outlet of said gas-liquid separating device.

10. The air temperature adjusting system, as recited in claim 2, wherein said liquid is magnetic fluid; said gas-liquid circulating device comprises an electromagnetic pump and a plurality of pipes respectively connected to respective two ends of said gas-liquid mixing device, said temperature adjusting device or said gas-liquid separating device; said temperature adjusting device is connected between said gas-liquid mixing device and said gas-liquid separating device via said pipes; and said electromagnetic pump is sleeved onto said pipes.

11. The air temperature adjusting system, as recited in claim 10, wherein said temperature adjusting device comprises an electronic cooling device and/or an electronic heating device.

12. The air temperature adjusting system, as recited in claim 1, wherein said liquid is water; said gas-liquid circulating device comprises a submersible pump and a plurality of water pipes respectively connected to respective two ends of said submersible pump, said gas-liquid mixing device, said temperature adjusting device and said gas-liquid separating device; said temperature adjusting device is connected between said gas-liquid mixing device and said gas-liquid separating device via said water pipes; and said submersible pump is provided between two members selected from a group consisting of said gas-liquid mixing device, said temperature adjusting device and said gas-liquid separating device.

13. The air temperature adjusting system, as recited in claim 12, wherein a water inlet of said gas-liquid mixing device has a higher water level than a water outlet of said gas-liquid mixing device.

14. The air temperature adjusting system, as recited in claim 13, wherein said submersible pump is provided inside a liquid storing box of said gas-liquid separating device.

15. The air temperature adjusting system, as recited in claim 12, wherein said submersible pump works in an intermittently pumping manner.

16. The air temperature adjusting system, as recited in claim 15, wherein said temperature adjusting device comprises an electronic cooling device and/or an electronic heating device.

17. The air temperature adjusting system, as recited in claim 12, further comprising an ultraviolet disinfecting device which is provided in said liquid.

18. The air temperature adjusting system, as recited in claim 12, further comprising a filtering device for filtering off said liquid which is provided at a gas outlet of said gas-liquid separating device.

19. The air temperature adjusting system, as recited in claim 1, wherein said liquid is magnetic fluid; said gas-liquid circulating device comprises an electromagnetic pump and a plurality of pipes respectively connected to respective two ends of said gas-liquid mixing device, said temperature adjusting device or said gas-liquid separating device; said temperature adjusting device is connected between said gas-liquid mixing device and said gas-liquid separating device via said pipes; and said electromagnetic pump is sleeved onto said pipes.

20. The air temperature adjusting system, as recited in claim 19, wherein said temperature adjusting device comprises an electronic cooling device and/or an electronic heating device.

* * * * *